US008115718B2

(12) United States Patent
Chen et al.

(10) Patent No.: US 8,115,718 B2
(45) Date of Patent: Feb. 14, 2012

(54) COLOR PASSIVE MATRIX BISTABLE LIQUID CRYSTAL DISPLAY SYSTEM AND METHOD FOR DRIVING THE SAME

(75) Inventors: Chih-Jen Chen, Hsin Chu Hsien (TW); Chih-Chiang Lu, Hsin Chu Hsien (TW); Tai-Ann Chen, Hsin Chu Hsien (TW); Chung-Yi Chang, Hsin Chu Hsien (TW)

(73) Assignee: Industrial Technology Research Institute, Hsin Chu Hsien (TW)

( * ) Notice: Subject to any disclaimer, the term of this patent is extended or adjusted under 35 U.S.C. 154(b) by 1117 days.

(21) Appl. No.: 11/802,699

(22) Filed: May 24, 2007

(65) Prior Publication Data

US 2008/0150868 A1 Jun. 26, 2008

(30) Foreign Application Priority Data

Dec. 22, 2006 (TW) ..... 95148360 A

(51) Int. Cl.
*G09G 3/36* (2006.01)

(52) U.S. Cl. ..... 345/95; 345/94

(58) Field of Classification Search ..... 345/94–97
See application file for complete search history.

(56) References Cited

U.S. PATENT DOCUMENTS

| | | | | |
|---|---|---|---|---|
| 5,122,783 | A * | 6/1992 | Bassetti, Jr. | 345/88 |
| 6,323,871 | B1 * | 11/2001 | Fujiyoshi et al. | 345/598 |
| 6,519,013 | B1 * | 2/2003 | Nagai et al. | 349/33 |
| 7,022,259 | B2 | 4/2006 | Lee et al. | |
| 2005/0174340 | A1 * | 8/2005 | Jones | 345/204 |
| 2009/0096738 | A1 * | 4/2009 | Chen et al. | 345/98 |

FOREIGN PATENT DOCUMENTS

| | | | |
|---|---|---|---|
| TW | 200511173 | A | 2/1993 |
| TW | 200643882 | A | 6/1994 |

* cited by examiner

*Primary Examiner* — Richard Hjerpe
*Assistant Examiner* — Dorothy Harris
(74) *Attorney, Agent, or Firm* — Birch, Stewart, Kolasch & Birch, LLP

(57) ABSTRACT

This invention provides a color passive matrix bistable liquid crystal display system, in which one respective scan line corresponds to sub-pixels of same color and neighboring scan lines correspond to sub-pixels of different colors. The scan lines are grouped in accordance with the colors of the sub-pixels corresponding thereto such that different scan driving voltages can be provided to the sub-pixels of different colors when the scan lines are scanned. By way of the arrangement of the sub-pixels, different scan driving voltages are switched to the respective scan lines in accordance with the colors of the sub-pixels corresponding thereto. As a result, a demand that the sub-pixels of different colors require different scan driving voltages is satisfied. The image quality is improved.

12 Claims, 3 Drawing Sheets

COLOR PASSIVE MATRIX BISTABLE LIQUID CRYSTAL DISPLAY SYSTEM AND METHOD FOR DRIVING THE SAME

BACKGROUND OF THE INVENTION

1. Field of the Invention

The present invention relates to a passive matrix bistable liquid crystal display system, and more particularly to a color passive matrix bistable liquid crystal display system and a method for driving the same.

2. Description of the Related Art

FIG. 1 is a schematic block diagram of the conventional color passive matrix bistable liquid crystal display device, which includes a lower substrate 100, a plurality of data electrodes 101 aligned in parallel, a plurality of scan electrodes 102 aligned in parallel, a data line driver 103, a scan line driver 104, a controller 102, a voltage source 106, a clock 107 and a plurality of blue light bistable liquid crystal cells (B) 108B, a plurality of green light bistable liquid crystal cells (G) 108G and a plurality of red light bistable liquid crystal cells (R) 108R. The data electrodes 101 are disposed on one surface of the lower substrate 100, and the scan electrodes 102 are perpendicularly stacked over the data electrodes 101. An intersection area of each of the scan electrodes 102 and each of the data electrodes 101 defines a sub-pixel area 108. For one respective scan electrode 102, the blue light bistable liquid crystal cells 108B, green light bistable liquid crystal cells 108G and the red light bistable liquid crystal cells 108R are sequentially sandwiched between one respective scan electrode 102 and the data electrodes 101 corresponding to the respective intersection areas thereof. In other words, for the conventional color passive matrix bistable liquid crystal display device, the liquid crystal cells of same color are aligned in a direction perpendicular to the scan electrodes 102. The data line driver 103 electrically connects with each of the data electrodes 101 to provide addressing data voltages to the data electrodes 101. The scan line driver 104 electrically connects with each of the scan electrodes 102 to provide scan driving voltages to the scan electrodes 102. The controller 105 is used to control the transmissions of the addressing data voltages of the data electrodes 101 and the scan driving voltages of the scan electrodes 102. The data voltages of the image signals are sequentially transmitted to the controller 105 through the voltage source 106 and the clock 107. Then, the controller 105 controls the scan line driver 104 to sequentially scan the scan electrodes 102. When the respective scan electrode 102 is scanned, the controller 105 controls the data line driver 103 to transmit the addressing data voltages to the data electrodes 101 to write the sub-pixel data into the corresponding sub-pixels.

FIG. 2 is an electro-optical graph of a known red light bistable liquid crystal, green light bistable liquid crystal and blue light bistable liquid crystal, and FIG. 3 is an electro-optical graph of another known red light bistable liquid crystal, green light bistable liquid crystal and blue light bistable liquid crystal. In view of FIG. 2 and FIG. 3, it can be seen that the scan driving voltages of the bistable liquid crystal cells of different illuminating colors are different, in which the scan driving voltage of the red light bistable liquid crystal cells is lowest, while the scan driving voltage of the blue light bistable liquid crystal cells is highest. In terms of the pixel arrangement of the conventional color passive matrix bistable liquid crystal display device, the respective scan electrode 102 corresponds to the liquid crystal cells of different illuminating colors. When the respective scan electrode 102 is scanned, the liquid crystal cells of different illuminating colors corresponding thereto are provided with the same scan driving voltage. As such, the pixel arrangement and driving method of the conventional color passive matrix bistable liquid crystal display device can not meet the demand that the liquid crystal cells of different illuminating colors have different scan driving voltages.

Taking FIG. 3 as an example, the highest driving voltages of the data electrodes with respect to the red light, green light and blue light liquid crystals are different, i.e. the voltage levels of the data electrodes respectively corresponding thereto are different. As to the conventional driving method, the data electrodes 101 are divided to three groups, when the respective scan electrode 101 is scanned, three respective voltage levels are provided to the corresponding data electrodes 101 to satisfy the demand that the liquid crystals of three different illuminating colors have different voltage levels. It is necessary to develop additional addressing circuits to provide respective addressing voltages to the liquid crystals of different illuminating colors, and that makes the circuit design of the data line driver 103 become more complicated. The conventional color passive matrix bistable liquid crystal device needs to be improved to alleviate the above drawbacks.

SUMMARY OF THE INVENTION

The present invention provides a color passive matrix bistable liquid crystal display system, in which sub-pixels of same color are arranged to correspond to one respective scan line and sub-pixels of different colors are arranged to correspond to neighboring scan lines, and the scan lines are grouped in accordance with the colors of the sub-pixels corresponding thereto such that different scan driving voltages can be switched when the scan lines are scanned, and thus providing the same scan driving voltage to the sub-pixels of same color and different scan driving voltages to the sub-pixels of different colors.

The color passive matrix bistable liquid crystal display system includes a plurality of data electrodes aligned in parallel, a plurality of scan electrodes aligned in parallel, a pixel scan line driver, a data line driver and a timing controller. The scan electrodes are perpendicular to the data electrodes and both overlap each other. An intersection area of each of the scan electrodes and each of the data electrodes defines a sub-pixel, and each of the scan electrodes corresponds to a plurality of the sub-pixels of same color, while the neighboring scan electrodes respectively correspond to the sub-pixels of different colors. The sub-pixels of different colors are constituted by bistable liquid crystals with different illuminating colors. The pixel scan line driver electrically connects with the scan electrodes and provides respective scan driving voltages to the scan electrodes in accordance with the illuminating colors of the sub-pixels corresponding thereto. The data line driver electrically connects with the data electrodes to provide data voltages to the data electrodes. The timing controller is used to control the pixel scan line driver and the data line driver to transmit the respective scan driving voltages and data voltages.

In one another aspect, the color passive matrix bistable liquid crystal display system of the present invention includes a line buffer for resorting the sub-pixels of the whole graphic display received by the timing controller prior to scanning the scan electrodes such that the data line driver can simultaneously transmit the data voltage for the sub-pixels of same color to the data electrodes corresponding to one respective scan electrode.

Additionally, the data electrodes of the present color passive matrix bistable liquid crystal display system can be switched to the respective voltage levels corresponding to the sub-pixels of different colors when the scan lines are scanned so as to satisfy the situation that the voltage levels of the data electrodes for the sub-pixels of different colors are different. And thus, it is not necessary to develop additional addressing data driving circuit for providing respective addressing voltages to the sub-pixels of different colors.

By way of the arrangement of the sub-pixels, the present color passive matrix bistable liquid crystal display system can satisfy the demand that the respective scan driving voltage levels and the respective data voltage levels corresponding to the sub-pixels of different colors are different without increasing the complexity of the circuit design of the driving system. The image quality is improved.

DETAILED DESCRIPTION OF THE PREFERRED EMBODIMENTS

The present invention provides a color passive matrix bistable liquid crystal display system, which provides respective scan driving voltages to the scan electrodes in accordance with the illuminating colors of the sub-pixels corresponding thereto for driving the liquid crystals such that the demand that the sub-pixels of different colors require different scan driving voltages is satisfied. In other words, the present invention provides an appropriate arrangement of the liquid crystals of different illuminating colors to meet the need of the color passive matrix bistable liquid crystal display device and a driving system suitable for the same. In the present invention, the liquid crystals of different illuminating colors are aligned in the directions perpendicular to the scan electrodes and the liquid crystals of same illuminating colors are aligned in the directions parallel to the scan electrodes. Moreover, the present system provides a line buffer for resorting the pixel data transmitted in a standard way that the pixel data are transmitted by one red sub-pixel, one green sub-pixel and one blue sub-pixel as a transmission unit per time after the driving system receives the pixel data of different colors of the whole graphic display, and then transmitting the sub-pixel data of same color corresponding to one respective scan electrode to the data electrodes.

The color passive matrix bistable liquid crystal display system of the present invention and a method for driving the same will be described in detail in accordance with preferred embodiments with reference to accompanying drawings.

Figure 4:
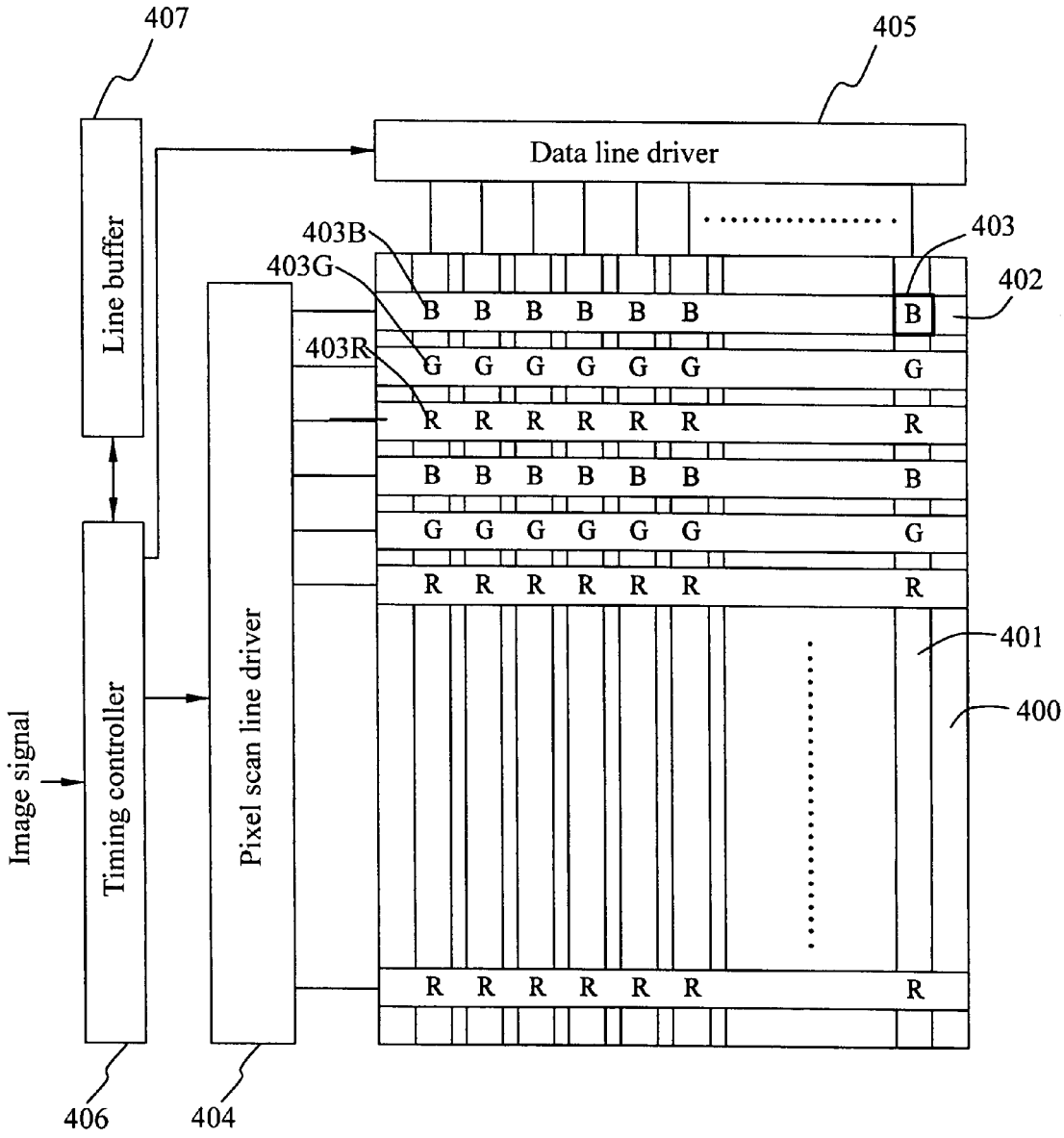
FIG. 4 is a schematic functional block diagram of a color passive matrix bistable liquid crystal display system of the present invention.

FIG. 4 is a schematic functional block diagram of the color passive matrix bistable liquid crystal display system according to one preferred embodiment of the present invention. In this preferred embodiment, the present color passive matrix bistable liquid crystal display system includes a lower substrate 400, a plurality of data electrodes 401, a plurality of scan electrodes 402, a plurality of blue light bistable liquid crystal cells 403B, a plurality of green light bistable liquid crystal cells 403G, a plurality of red light bistable liquid crystal cells 403R, a pixel scan line driver 404, a data line driver 405, a timing controller 406 and a line buffer 407. The data electrodes 401 are aligned in parallel and disposed on a surface of the lower substrate 400. The scan electrodes 402 are aligned in parallel and disposed over the data electrodes 401 and perpendicular to the data electrodes 401. An intersection area of each of the data electrodes 401 and each of the scan electrodes 402 defines a sub-pixel area 403. The blue light bistable liquid crystal cells 403B, green light bistable liquid crystal cells 403G and the red light bistable liquid crystal cells 403R are sandwiched between the data electrodes 401 and the scan electrodes 402 corresponding to the respective intersection areas thereof. The bistable liquid crystal cells of same color are sandwiched between one respective scan electrode 402 and each of the data electrodes 401 corresponding to the respective intersection areas thereof. The bistable liquid crystal cells of different colors are sandwiched between one respective data electrode 401 and each of the neighboring scan electrodes 402 corresponding to the respective intersection areas thereof. In other words, the liquid crystal cells of same color are aligned in parallel to the scan electrodes 402 and the liquid crystal cells of different colors are aligned perpendicular to the scan electrodes 402. In this preferred embodiment, more specifically, the blue light bistable liquid crystal cell 403B, the green light bistable liquid crystal cell 403G and the red light bistable liquid crystal cell 403R are sequentially sandwiched between the scan electrodes 402 and the data electrodes 401 corresponding to the respective intersection areas along the direction perpendicular to the scan electrodes 402. The scan electrodes 402 are electrically coupled to the pixel scan line driver 404. The scan electrodes 402 are grouped in accordance with the different illuminating colors of the sub-pixels 403 such that the pixel scan line driver 404 provides respective scan driving voltages to the scan electrodes 402 in accordance with the illuminating colors of the sub-pixels 403 corresponding thereto. The data line driver 405 is electrically coupled to the data electrodes 401 to provide addressing data voltages to the data electrodes 401. The timing controller 406 is electrically coupled to the data line driver 405 and the pixel scan line driver 404 to control the transmission of the addressing data voltages and the scan driving voltages. The line buffer 407 is connected to the timing controller 406 such that after the timing controller 406 receives image signals of the whole graphic display, i.e. after receiving the blue light sub-pixel data 403B, the green light sub-pixel data 403G and the red light sub-pixel data 403R of the whole graphic display, the line buffer 407 resorts the sub-pixel data of the whole graphic display, and then transmitting to the data line driver 405 through the timing controller 406 so that the data line driver 405 can simultaneously transmit the data voltages of the sub-pixels of same color to the data electrodes 401 corresponding to one respective scan electrode 402. As such, the present display system can be compatible with the standard pixel data transmission method that the red light sub-pixel data, the green light sub-pixel data and the blue light sub-pixel data are as a transmission unit per time.

Figure 1:
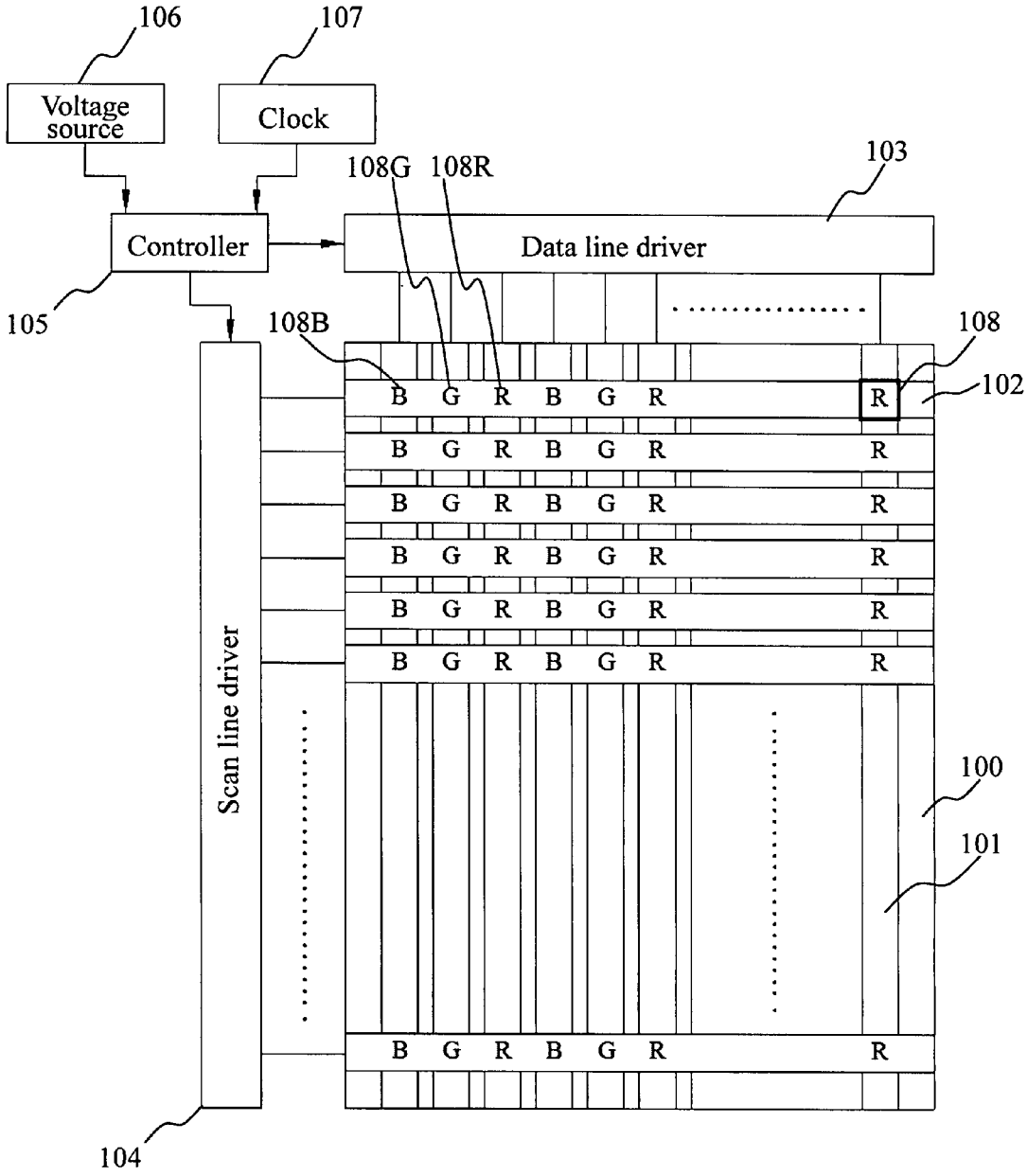
Fig. 1 (Prior Art)
FIG. 1 is a schematic functional block diagram of a conventional color passive matrix bistable liquid crystal display device.
Figure 2:
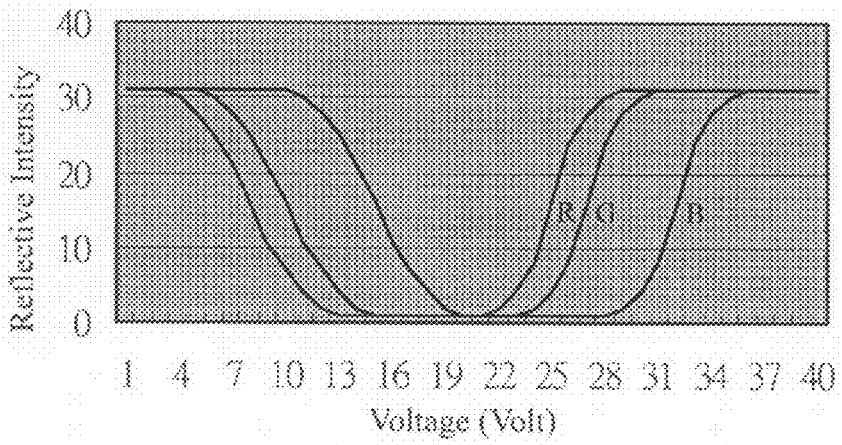
Fig. 2 (Prior Art)
FIG. 2 is an electro-optical graph of a known red light bistable liquid crystal, green light bistable liquid crystal and blue light bistable liquid crystal.
Figure 3:
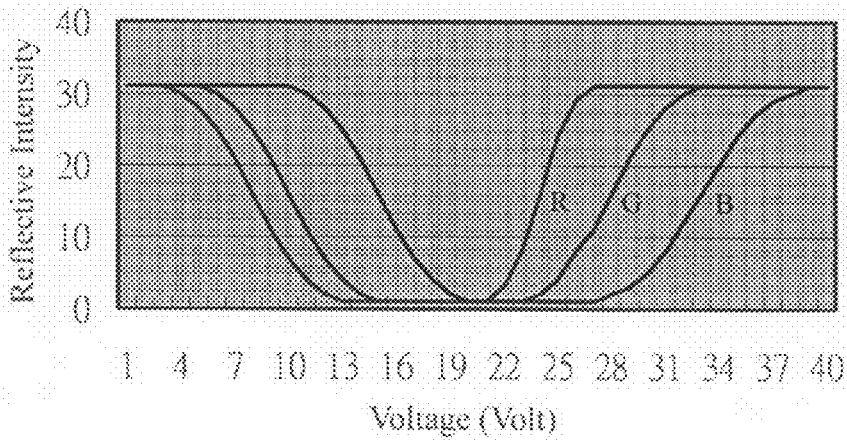
Fig. 3 (Prior Art)
FIG. 3 is an electro-optical graph of another known red light bistable liquid crystal, green light bistable liquid crystal and blue light bistable liquid crystal.
Figure 5:
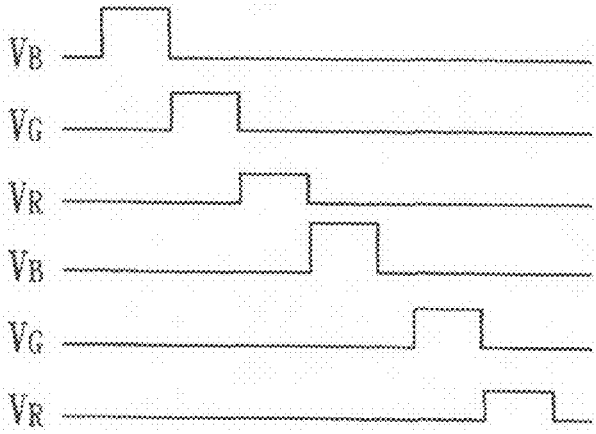
FIG. 5 is a timing diagram of scan driving voltages of the color passive matrix bistable liquid crystal display system of the present invention.

FIG. 5 is a timing diagram of the scan driving voltages of the present color passive matrix bistable liquid crystal display system. After the timing controller 406 receives the pixel data of the whole graphic display, the line buffer 407 resorts the pixel data to become one respective pixel line is formed of the sub-pixel data of the same color, and then transmitting the respective resorted line pixel data formed of the same color sub-pixel data to the timing controller 406. Next, the timing controller 406 controls the pixel scan line driver 404 to sequentially transmit the respective scan driving voltages $V_B$, $V_G$ and $V_R$ to the respective scan electrodes 402 corresponding thereto so as to drive the corresponding bistable liquid crystal cells. After one of the scan electrodes 402 is applied with the respective scan driving voltage, the data line driver 405 transmits the addressing data voltages from the timing controller 406 to the data electrodes 401 to write the sub-pixel data into the corresponding bistable liquid crystal cells. The present invention proposes a sub-pixel arrangement design and a concept that grouping the sub-pixels in accordance with their illuminating colors, and thereby the pixel scan line driver provides the respective scan driving voltages to the corresponding scan electrodes in accordance with the illuminating colors of the sub-pixels corresponding thereto. As shown in FIG. 2 and FIG. 3, the scan driving voltage of the red light bistable liquid crystal cells is lowest, but the scan driving voltage of the blue light bistable liquid crystal cells is highest. As a consequence, the present invention can provide the respective scan driving voltages to the scan electrodes 402 in accordance with the illuminating colors of the sub-pixels corresponding thereto when sequentially scanning the scan electrodes 402. The efficiency for driving the liquid crystal cells is improved.

FIG. 3 is an electro-optical graph of the known red light bistable liquid crystal cells, green light bistable liquid crystal cells and blue light bistable liquid crystal cells, showing that the slopes of the right-side curves of the electro-optical graph corresponding to the crystal liquid cells of different illuminating colors are different. As such, the data voltages of the data electrodes 401 corresponding to the sub-pixels 403 of different colors are different. In other words, the voltages of the data electrodes 401 of the blue light liquid crystal cells, the green light liquid crystal cells and the red light liquid crystal cells are different. Under this circumstance, when the respective scan line (the scan electrode 402) is scanned, the data addressing positions in the direction perpendicular to the scanned scan line correspond to the liquid crystal cells of same color. As such, the data addressing voltage levels are the same when the respective scan line is changed. Only the scan line is changed, the data addressing voltage levels are changed. By way of the inventive concept of the present invention that the liquid crystal cells of same color are aligned in parallel and the liquid crystal cells are grouped in accordance with the illuminating colors thereof, the data addressing voltage levels are changed only as the scan line is changed. It is not necessary to develop respective data addressing driving circuits for the liquid crystal cells of different illuminating colors to meet the demand that the liquid crystal cells of different illuminating colors have different data addressing voltage levels. Therefore, the circuit design of the driving system of the present invention can cost down. In addition, the present invention can base on the electro-optical characteristics of the liquid crystal cells to keep the data addressing voltage levels in the direction perpendicular to the scan lines being the same when changing the respective scan lines. Hence, it does not need to change the data addressing voltage levels when scanning the respective scan lines.

By way of the arrangement of the sub-pixels, the present color passive matrix bistable liquid crystal display system can satisfy the demand that the respective scan driving voltage levels and the respective data voltage levels corresponding to the sub-pixels of different colors are different without increasing the complexity of the circuit design of the driving system. The image quality is improved.

While the invention has been described by way of examples and in terms of preferred embodiments, it is to be understood that those who are familiar with the subject art can carry out various modifications and similar arrangements and procedures described in the present invention and also achieve the effectiveness of the present invention. Hence, it is to be understood that the description of the present invention should be accorded with the broadest interpretation to those who are familiar with the subject art, and the invention is not limited thereto.

What is claimed is:

1. A colorful passive matrix bistable liquid crystal display system, comprising:

a plurality of data electrodes aligned in parallel;

a plurality of scan electrodes aligned in parallel, wherein said scan electrodes are perpendicular to said data electrodes and both overlap each other, an intersection area of each said scan electrode and each said data electrode defines a sub-pixel, and each said scan electrode corresponds to a plurality of said sub-pixels of same color and said neighboring scan electrodes respectively correspond to said sub-pixels of different colors, said sub-pixels of different colors are constituted by red bistable liquid crystals, green bistable liquid crystals and blue bistable liquid crystals, wherein said red bistable liquid crystals, said green bistable liquid crystals and said blue bistable liquid crystals have the same cell size;

a pixel scan line driver electrically connecting with said scan electrodes and providing the same scan driving voltage to the sub-pixels of same color and different scan driving voltages to the sub-pixels of different color in accordance with the illuminating colors of said sub-pixels corresponding thereto, wherein the sub-pixels of red color have a lowest scan driving voltage and the sub-pixels of blue color have a largest scan driving voltage;

a data line driver electrically connecting with said data electrodes to provide data voltages to said data electrodes; and a timing controller for controlling said pixel scan line driver and said data line driver to transmit the respective scan driving voltages and data voltages.

2. The colorful passive matrix bistable liquid crystal display system as claimed in claim 1, wherein further comprises a line buffer for storing and resorting sub-pixel data received by said timing controller such that said data line driver simultaneously transmits sub-pixel data of same color to said data electrodes corresponding to one said scan electrode.

3. The colorful passive matrix bistable liquid crystal display system as claimed in claim 2, wherein said data electrodes have different voltage levels corresponding to said sub-pixels of different illuminating colors.

4. The colorful passive matrix bistable liquid crystal display system as claimed in claim 2, wherein said data electrodes have same voltage level corresponding to said sub-pixels of different illuminating colors.

5. The colorful passive matrix bistable liquid crystal display system as claimed in claim 1, wherein said data electrodes have different voltage levels corresponding to said sub-pixels of different illuminating colors.

6. The colorful passive matrix bistable liquid crystal display system as claimed in claim 1, wherein said data electrodes have same voltage level corresponding to said sub-pixels of different illuminating colors.

7. A colorful passive matrix liquid crystal display system, which comprises sub-pixels of same color corresponding to one same scan line and sub-pixels of different colors corresponding to neighboring scan lines, wherein the same scan driving voltage is provided to the sub-pixels of same color and different scan driving voltages is provided to the sub-pixels of different color, wherein said sub-pixels of different colors are constituted by red bistable liquid crystals, green bistable liquid crystals and blue bistable liquid crystals, said red bistable liquid crystals, said green bistable liquid crystals and said blue bistable liquid crystals have the same cell size, wherein the sub-pixels of red color have a lowest scan driving voltage and the sub-pixels of blue color have a largest scan driving voltage.

8. The colorful passive matrix liquid crystal display system as claimed in claim 7, wherein said scan lines are grouped in accordance with the colors of said sub-pixels, and each group of said scan lines corresponds to different scan driving voltages.

9. The colorful passive matrix liquid crystal display system as claimed in claim 7, wherein further comprises a line buffer for storing and resorting sub-pixels data prior to scanning said scan lines so as to simultaneously transmit sub-pixel data of same color corresponding to one said scan line.

10. A method for driving passive matrix display medium, which provides the same scan driving voltage corresponding to the sub-pixels of same color and different scan driving voltages corresponding to sub-pixels of different illuminating colors, wherein said sub-pixels of different illuminating colors are constituted by red bistable liquid crystals, green bistable liquid crystals and blue bistable liquid crystals, said red bistable liquid crystals, said green bistable liquid crystals and said blue bistable liquid crystals have the same cell size, wherein the sub-pixels of red color have a lowest scan driving voltage and the sub-pixels of blue color have a largest scan driving voltage.

11. The method for driving passive matrix display medium as claimed in claim 10, which provides different voltage levels to data electrodes corresponding to said sub-pixels of different illuminating colors.

12. The method for driving passive matrix display medium as claimed in claim 10, which provides same voltage level to data electrodes corresponding to said sub-pixels of different illuminating colors.

* * * * *